United States Patent [19]

Guimond

[11] Patent Number: 4,471,767

[45] Date of Patent: Sep. 18, 1984

[54] THERAPEUTIC DEVICE FOR POSITIONAL TREATMENT FOR GASTROESOPHAGEAL REFLUX

[76] Inventor: John W. Guimond, 1 St. John's Wood, English Village, Gansevoort, N.Y. 12831

[21] Appl. No.: 558,335

[22] Filed: Dec. 5, 1983

[51] Int. Cl.[3] ..... A61G 7/00

[52] U.S. Cl. ..... 128/24 R; 128/134; 5/431; 297/467

[58] Field of Search ..... 128/133–135, 128/75, 84 C, 24, 33; 5/60, 81 R, 100, 431–433, 424–425, 443–444; 297/464, 467–469, 274; 272/144

[56] References Cited

U.S. PATENT DOCUMENTS

| | | | |
|---|---|---|---|
| 2,495,482 | 1/1950 | Rogatz | 128/134 |
| 2,611,363 | 9/1952 | Peters | 128/134 |
| 2,777,138 | 1/1957 | Gallagher | 5/433 |
| 2,893,384 | 7/1959 | Chick | 128/75 |
| 3,353,532 | 11/1967 | Ellis | 128/75 |
| 3,423,773 | 1/1969 | Yamate | 5/433 |
| 3,431,020 | 3/1969 | Tyndall | 5/433 |
| 3,447,832 | 6/1969 | Shaw | 297/274 |
| 3,730,587 | 5/1973 | Bloxham et al. | 297/274 |
| 3,777,673 | 12/1973 | Blazey et al. | 5/424 X |
| 4,047,755 | 9/1977 | McDonald et al. | 297/464 X |
| 4,188,678 | 2/1980 | Rawolle | 5/433 |
| 4,441,221 | 4/1984 | Enste et al. | 5/431 |

FOREIGN PATENT DOCUMENTS

| | | | |
|---|---|---|---|
| 663322 | 5/1963 | Canada | 5/433 |

OTHER PUBLICATIONS

The device shown in FIG. 11-9 on p. 897 of the sub-title "Gastroesophageal Reflux" on pp. 896 and 897 of the publication entitled Nelson Textbook of Pediatrics, 1983, Twelfth Edition, by Richard E. Behrman, M.D. and Victor C. Vaughan, III, M.D., published by W. B. Saunders Company, West Washington Square, Philadelphia, PA 19105.

*Primary Examiner*—Richard J. Apley
*Assistant Examiner*—Chris Coppens
*Attorney, Agent, or Firm*—Walter F. Wessendorf, Jr.

[57] ABSTRACT

Disclosed is a therapeutic device for positional treatment of an infant child afflicted with gastroesophageal reflux. The device has a 30° inclined flat bed portion upon which the child is correspondingly inclined in a prone position. The child's legs are inserted through leg openings provided in a seat, mounted on the device via two support rods, with the seat's main body portion receiving and encircling the child's lower torso region, and affording him free and unrestricted movement of his legs and upper body. Padded sides channel the child longitudinally and prevent him from laterally rolling off.

7 Claims, 1 Drawing Figure

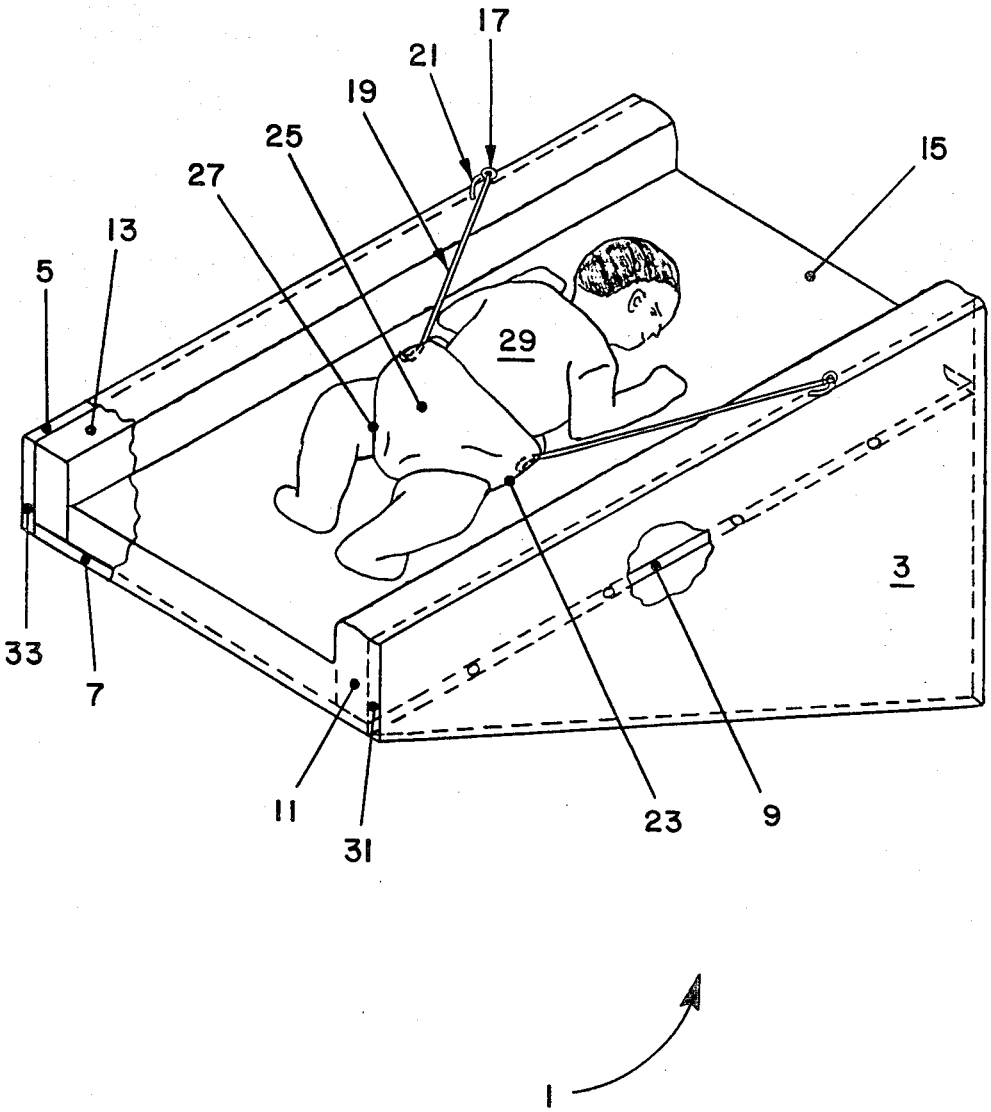
17
21
19
25
27
15
13
5
29
3
33
7
11
31
23
9
1

THERAPEUTIC DEVICE FOR POSITIONAL TREATMENT FOR GASTROESOPHAGEAL REFLUX

BACKGROUND OF THE INVENTION

1. Technical Field

This invention relates to a therapeutic device for positional treatment for gastroesophageal reflux.

2. Background

For an infant child afflicted with the problem of gastroesophageal reflux, positional treatment is indicated and produces excellent results. See, "Gastroesophageal Reflux" pp. 896 and 897 of the NELSON TEXTBOOK OF PEDIATRICS, 1983, Twelfth Edition, by Richard E. Behrman, M.D. and Victor C. Vaughan, III, M.D., published by W. B. SAUNDERS COMPANY, West Washington Square, Philadelphia, PA 19105. The infant is placed in a prone position lying at a 30° angle of inclination to aid the esophageal passage in remaining firm and tight. Positional treatment is employed 20 minutes to a half hour after each feeding to allow, with help from natural gravity, the ingested food to remain more easily in the digestive tract.

The problem in the art to which this invention apertains is the need for a therapeutic device for positional treatment so that the infant child can be easily and comfortably placed in the prone position lying at a 30° angle of inclination, and, in being so placed, the infant will have free and unrestricted movement of his legs, upper body, and his body weight will be secured in a seat, and is further prevented from rolling off the lateral sides of the device.

Accordingly, the object of the invention is to provide such a therapeutic device for positional treatment that will contribute to the solution of the discussed problems of the art and which can be utilized to place the infant child in such prone position lying at a 30° angle of inclination.

SUMMARY OF THE INVENTION

In accordance with the invention, there is provided a padded device of integral construction that is inclined. at an angle of 30° so that the infant can be easily and comfortably placed theeon in a prone position lying at a corresponding 30° angle of inclination. A plastic seat, operatively connected with the device, has two leg openings through which the infant's legs are inserted. Such plastic seat encircles the infant's lower torso region and affords the infant free and unrestricted movement of his legs, upper body with his body weight being secured thereby by such seat. Raised padded sides prevent the infant from rolling off either of the lateral sides of the device.

BRIEF DESCRIPTION OF THE DRAWINGS

This object and other objects of the invention should be discerned and appreciated from the detailed description taken in conjunction with the drawings in which the infant is shown placed in a prone position on the device lying at a 30° angle of inclination.

DESCRIPTION OF THE PREFERRED EMBODIMENT

In the drawings, reference numeral 1 generally refers to the invention of the therapeutic device for positional treatment for gastroesophageal reflux.

Device 1 comprises two vertical sides 3 and 5 fixedly carrying therebetween a flat bed portion 7 inclined at an angle of 30°. The flat bed portion 7 has its own lateral sides 9. The vertical sides 3 and 5 and flat bed portion 7 are made of plywood or other suitable material such as plastic. Fixedly carried by sides 3 and 5, and flat bed portion 7, are corresponding plastic-covered foam pads 11, 13 and 15, respectively.

Upstanding eye screws 17, suitably fixed to the vertical sides 3 and 5, as shown, removably mount support rods 19 via looped ends 21 operatively engaged with the eye portions of eye screws 17. The other ends of the support rods 19 fixedly carry a plastic seat 23 having a main body portion 25 and leg openings 27. The legs of the infant child 29 are inserted through the leg openings 27 with the main body portion 25 receiving and encircling the infant's lower torso region. The seat 23 affords the infant free and unrestricted movement of his legs and upper body, with his body weight being secured and carried by the seat 23.

In use, the infant's legs are appropriately inserted through the leg openings 27 of the plastic seat 23 to allow the main body portion 23 of such plastic seat 23 to encircle and mount the infant's lower torso region, preparatory to and in conjunction with disposing and placing the infant 29 in a prone position lying upon the plastic-covered foam pad 15 covering the flat bed portion 7.

Those portions of the vertical sides 3 and 5 that are contiguous with the lateral sides 9 of the flat bed portion 7 and rise above the plane of the flat bed portion 7 define raised sides 31 and 33, respectively, together with their corresponding plastic-covered foam pads 11 and 13, define raised padded sides, and function to channel the infant child 29 longitudinally within their spatial confines and to thereby prevent him from rolling off either of the lateral sides 9 of the flat bed portion 7 if the structure of the raised sides 31 and 33 were not present.

The dimensional width and length of the device 1 is spatially depicted as being a little wider and longer than the space occupied by the infant child 29 to allow continuous usage of the device 1 and to accommodate the infant child as he grows older and correspondingly larger.

It should be appreciated that the simple arrangement and structure of the seat 23 affords easy and simple emplacement upon and removal of the infant child 29 with respect to the plastic-covered bed pad 15.

Having thus described my invention, I claim:

1. A therapeutic device for positional treatment of an infant child afflicted with gastroesophageal reflux; said therapeutic device having inclined means for use in easily and comfortably placing the child at an inclined prone position, affording the infant free and unrestricted movement of his legs and upper body and preventing such infant from rolling off the lateral sides of said inclined means, and affording the infant movement of his lower torso region; said inclined means comprising a flat bed portion, raised sides, substantially rigid support rods and seat means; said flat bed portion being inclined for correspondingly inclined emplacement of the child in a prone position thereon, said raised sides being contiguous with said lateral sides of said flat bed portion and rising above the plane of said flat bed portion sufficiently to channel the infant child longitudinally therein, to prevent him from rolling off said lateral sides of said flat bed portion and to prevent him from moving laterally off the lateral sides while in such prone position, said raised sides carrying said support rods, said support rods carrying said seat means, said seat means encircling the child's lower torso region and affording the child free and restricted movement of his legs and upper body, and securing and carrying the infant child's body weight, and said seat means together with said support rods affording the child movement of his lower torso region.

2. A therapeutic device in accordance with claim 1, wherein said flat bed portion is inclined at an angle of approximately 30° .

3. A therapeutic device in accordance with claim 1, wherein said raised sides have portions facing inwardly, wherein said inwardly facing portions of said raised sides are padded and wherein said flat bed portion is padded.

4. A therapeutic device in accordance with claim 1, wherein said seat means has leg openings and a main body portion, wherein said leg openings allow the legs of the infant child to be inserted therethrough and wherein said main body portion encircles the child's lower torso region.

5. A therapeutic device in accordance with claim 2, wherein said raised sides have portions facing inwardly, wherein said inwardly facing portions of said raised sides are padded and wherein said flat bed portion is padded.

6. A therapeutic device in accordance with claim 2, wherein said seat means has leg openings and a main body portion, wherein said leg openings allow the legs of the infant child to be inserted therethrough and wherein said main body portion encircles the child's lower torso region.

7. A therapeutic device in accordance with claim 6, wherein said raised sides have portions facing inwardly, wherein said inwardly facing portions of said raised sides are padded and wherein said flat bed portion is padded.

* * * * *